US012193582B1

(12) United States Patent
Kerill

(10) Patent No.: US 12,193,582 B1
(45) Date of Patent: Jan. 14, 2025

(54) TELESCOPING OR COLLAPSING ELEPHANT TRUNK SHAPED SPOUT FOR BOTH TOXIC AND NON-TOXIC FLUIDS

(71) Applicant: Bruce Kerill, West Chicago, IL (US)

(72) Inventor: Bruce Kerill, West Chicago, IL (US)

( * ) Notice: Subject to any disclaimer, the term of this patent is extended or adjusted under 35 U.S.C. 154(b) by 242 days.

(21) Appl. No.: 17/892,812

(22) Filed: Aug. 22, 2022

(51) Int. Cl.
*A47G 19/22* (2006.01)
*A47G 21/18* (2006.01)

(52) U.S. Cl.
CPC ..... *A47G 19/2227* (2013.01); *A47G 19/2272* (2013.01); *A47G 21/182* (2013.01); *A47G 21/189* (2013.01)

(58) Field of Classification Search
CPC ..... A47G 19/2227; A47G 19/2272; A47G 21/182; A47G 21/189
USPC ..... 222/78, 568, 464.1, 464.5, 480, 481, 222/481.5
See application file for complete search history.

(56) References Cited

U.S. PATENT DOCUMENTS 151,775 A * 6/1874 Hall ..... B65D 1/32 222/215
229,805 A * 7/1880 Coleman et al. .... B65D 47/263 222/536
540,083 A * 5/1895 Wilmot ..... B65D 25/48 222/568
1,362,186 A * 12/1920 Price ..... B65D 25/40 222/529
1,660,085 A * 2/1928 Elnain ..... A63H 3/005 222/211
1,893,972 A * 1/1933 Whitman ..... B67D 7/84 446/337
2,060,512 A * 11/1936 Magill ..... B67D 1/0425 222/401
2,546,122 A * 3/1951 Goldfarb ..... A47G 19/2222 220/287
2,731,751 A * 1/1956 Green ..... B44C 5/00 446/72
2,739,420 A * 3/1956 Dugdale ..... A63H 3/24 446/132

(Continued)

FOREIGN PATENT DOCUMENTS

WO WO-2018134624 A1 * 7/2018 ..... B29C 45/0001

*Primary Examiner* — Paul R Durand
*Assistant Examiner* — Michael J. Melaragno
(74) *Attorney, Agent, or Firm* — Sandy Lipkin

(57) ABSTRACT

A pour spout that is shaped like an elephant's trunk that can be used for both toxic and non-toxic fluids. To be used in toxic fluids, for example, the spout can be used to transfer engine fluids from their containers into an engine wherein the spout is telescoping in order to manipulate the direction of the spout. To be used for non-toxic, potable fluids, for example, the spout can be used on a child's cup as a novelty toy or animal wherein the spout can telescope as it attaches to a straw inside of the cup or it can collapse into the profile of the container portion of the cup. When used a child's cup, the spout can also the take the shape of other animals, such as an anteater, a duckbill, an aardvark or even a dog with a large snout and maintain its functionality in telescoping or collapsing. In the child's cup embodiment, other features representing animal features, such as elephant ears can be added to the cup for play and function and a valve is included in the container portion of the cup to remove excess air from the container.

7 Claims, 4 Drawing Sheets

(56) References Cited

U.S. PATENT DOCUMENTS 3,131,870 A * 5/1964 Henchert ..... B65D 47/148 239/602
3,420,412 A * 1/1969 Greene ..... B65D 81/365 222/78
3,998,364 A * 12/1976 Hollander ..... B67D 1/0456 222/394
4,588,111 A * 5/1986 Hestehave ..... B67D 7/005 222/479
4,597,513 A * 7/1986 Schiemann ..... B65D 47/06 222/478
4,832,238 A * 5/1989 Taylor ..... B65D 25/48 D7/700
4,921,147 A * 5/1990 Poirier ..... B65D 25/44 220/666
4,953,725 A * 9/1990 Gil Buj ..... A47G 19/2266 220/710
5,000,360 A * 3/1991 Lown ..... B67D 7/005 222/521
5,020,702 A * 6/1991 James ..... B67C 11/04 222/529
5,092,498 A * 3/1992 Willems ..... B65D 25/50 222/573
5,125,577 A * 6/1992 Frankel ..... E03C 1/046 239/289
5,186,358 A * 2/1993 McVay ..... B67C 11/02 222/181.2
5,201,460 A * 4/1993 Caines ..... A47G 21/18 220/705
D371,934 S * 7/1996 Cwirko ..... D7/901
5,540,611 A * 7/1996 Lapoint ..... B65D 81/366 446/72
5,593,641 A * 1/1997 Hornberger, Sr. ..... A61L 9/14 422/123
5,833,099 A * 11/1998 Boaz ..... B05C 17/00596 222/568
5,901,887 A * 5/1999 Wark ..... B65D 25/48 285/148.22
5,988,442 A * 11/1999 Corey ..... B65D 35/38 222/78
6,076,712 A * 6/2000 Esber ..... B05C 17/00596 222/570
6,286,731 B1 * 9/2001 Lillelund ..... B65D 47/0895 222/480
6,425,498 B1 * 7/2002 Gheorgheos ..... B67D 1/0456 206/139
6,523,720 B1 * 2/2003 Robbins, III ..... B65D 1/0246 222/481.5
6,820,774 B2 * 11/2004 Jones ..... B67D 1/0425 222/207
7,025,653 B1 * 4/2006 Hawkins ..... A63H 3/005 215/229
7,029,360 B1 * 4/2006 Hawkins ..... B65D 81/366 215/229
8,328,113 B2 * 12/2012 Stribling ..... A47G 21/185 239/33
8,561,851 B1 * 10/2013 Leonoff ..... F16K 15/147 137/853
8,727,187 B2 * 5/2014 Magley, II ..... B67D 7/005 222/481.5
2001/0011446 A1 * 8/2001 McClean ..... B65D 47/0847 264/238
2002/0070249 A1 * 6/2002 Gheorgheos ..... B67D 1/0456 222/464.5
2004/0031176 A1 * 2/2004 MBacke ..... G09F 19/14 40/453
2004/0035819 A1 * 2/2004 Dennison ..... B65D 47/065 215/386
2004/0035985 A1 * 2/2004 Fishler ..... A61J 9/0607 248/102
2004/0050870 A1 * 3/2004 Jones ..... B05B 11/0029 222/400.8
2004/0116036 A1 * 6/2004 Nugent ..... B65D 81/366 215/388
2004/0217136 A1 * 11/2004 Lu ..... B65D 47/265 222/480
2007/0246486 A1 * 10/2007 Calandrino ..... A47K 5/12 222/321.1
2008/0314933 A1 * 12/2008 Leonoff ..... B65D 23/00 222/215
2011/0132931 A1 * 6/2011 Wright ..... A47K 5/14 222/173
2011/0155771 A1 * 6/2011 Brooks ..... F16K 15/147 222/481
2013/0008926 A1 * 1/2013 Bell ..... B65D 47/043 222/568
2013/0214007 A1 * 8/2013 Simonian ..... B65D 51/1644 222/189.06
2013/0240575 A1 * 9/2013 Basic ..... A47K 7/08 222/566
2013/0334167 A1 * 12/2013 Kennell ..... B65D 23/08 215/388
2014/0061248 A1 * 3/2014 Hoskins ..... B65D 51/1644 222/215
2014/0263481 A1 * 9/2014 Lu ..... B05B 1/00 222/568
2016/0060002 A1 * 3/2016 Karotko ..... B65D 25/48 222/464.5
2019/0290037 A1 * 9/2019 Wiesman ..... A47G 21/186
2023/0363979 A1 * 11/2023 Barden ..... B65D 41/04

* cited by examiner

TELESCOPING OR COLLAPSING ELEPHANT TRUNK SHAPED SPOUT FOR BOTH TOXIC AND NON-TOXIC FLUIDS

BACKGROUND OF THE INVENTION

Field of the Invention

The field of this invention relates generally to the field of pour spouts for toxic and non-toxic fluids, and more particularly toward a spout that is shaped like an elephant trunk with a telescoping or collapsing feature.

Description of the Prior Art

When transferring liquids of any type, the use of a pour spout is often used to diminish the chance of spillage and loss of the fluid outside of the containers both to and from which it is being transferred. Spouts are used often when changing oil and other fluids in engines to keep the fluids from spilling into the engine, on to the ground and to minimize waste. Pour spouts can also be used to transfer potable liquids, such as water and juices in the form of a straw from a receptacle such as a cup into the user's mouth.

It is the object of the instant invention to provide for a spout that can be used for both potable fluids on cups containing drinks as well as the transfer of toxic fluids, such as engine fluids, from their containers to a secondary location.

It is a further object of the instant invention that the spout be shaped like an elephant's trunk and be telescoping or collapsing so that it's length can be shortened or lengthened as desired in the case of telescoping or the profile of the container for the fluid can be modified when in use versus when not in use.

It is a further object of the instant invention to provide for provide for more than one opening size at the end of the spout to allow for variable flow rates.

It is a further object of the instant invention to create the formation of a child's drinking cup using the spout that includes other features such as a check valve in the cup and other manipulatable features on the cup for a child's enjoyment.

SUMMARY OF THE INVENTION

The basic embodiment of the present invention teaches a spout for the transfer of liquids comprising: a base that is attachable to a receptacle for the collection or extraction of fluids, wherein said base is shaped to resemble an animal with a large appendage; universal threading at said base that allows for attachment to said receptacle; an extendible telescoping member extending from said base that allows for the flow of fluids therethrough as it exits said receptacle or as it is added to said receptacle; and a valve at an end of said telescoping member distal said base that controls the flow rate of fluids into or out from said telescoping member.

The above embodiment can be further modified by defining that a flow vent is attached to said base wherein said flow vent can be toggled fully open, fully closed or partially open.

The above embodiment can be further modified by defining that animal ears consistent with the animal portrayed are attached to said base to allow for gripping and turning of said spout for attachment through said universal threading to said receptacle.

The above embodiment can be further modified by defining that animal eyes consistent with the animal portrayed are attached to said base and wherein said animal eyes are constructed to provide the illusion that said eyes are following the user as the user moves.

The above embodiment can be further modified by defining that said appendage is surrounded by a sheath when said appendage is used as a straw to extract fluids from said receptacle.

The above embodiment can be further modified by defining that a removable cap is attachable to said distal end of said appendage.

The above embodiment can be further modified by defining that said straw is attached to an elbow joint that extends into said receptacle.

The above embodiment can be further modified by defining that said receptable includes a reversible check valve.

The above embodiment can be further modified by defining that a mouth consistent with the animal portrayed is included wherein a flow vent is situated in said mouth.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
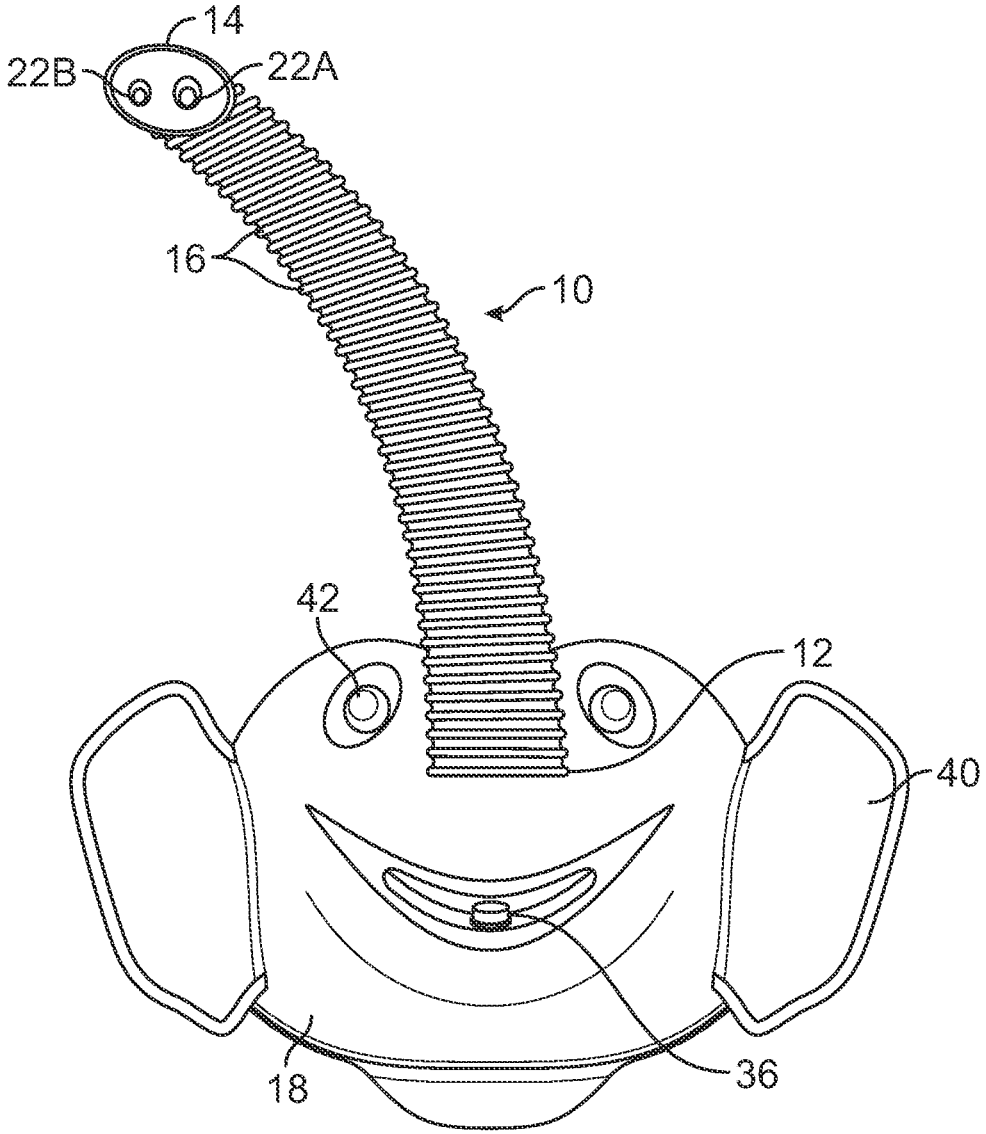
FIG. 1 is a to perspective view of the spout of the instant invention.

Turning to the drawings, the preferred embodiment is illustrated and described by reference characters that denote similar elements throughout the several views of the instant invention.

The preferred embodiment of the instant invention provides for a spout 10 that is tapered such that the base 12 is thicker than the end 14. Along the length of the spout 10 is a plurality of portions 16 that allow for the spout 10 to either telescope back onto itself or to be bendable into desire angle. The base 12 attaches to lid 18 to be placed over the container 20 that houses the fluid that will either be transferred or sipped to drink. The lid 18 can be designed, as shown to resemble an elephant as the spout resembles an elephant's trunk. The invention is not limited, however, to just resembling an elephant. An elephant is used for illustrative purposes, but it is contemplated that it can resemble any animal that has a long snout, such as an anteater, a duckbill, an aardvark or even a dog with a large snout. It is contemplated that when the spout is used for a child's drinking cup, as we see illustrated herein, the other features of the animal, such as the ears and mouth can be utilized as ornamental features or even manipulated parts for a child to play with.

Figure 2:
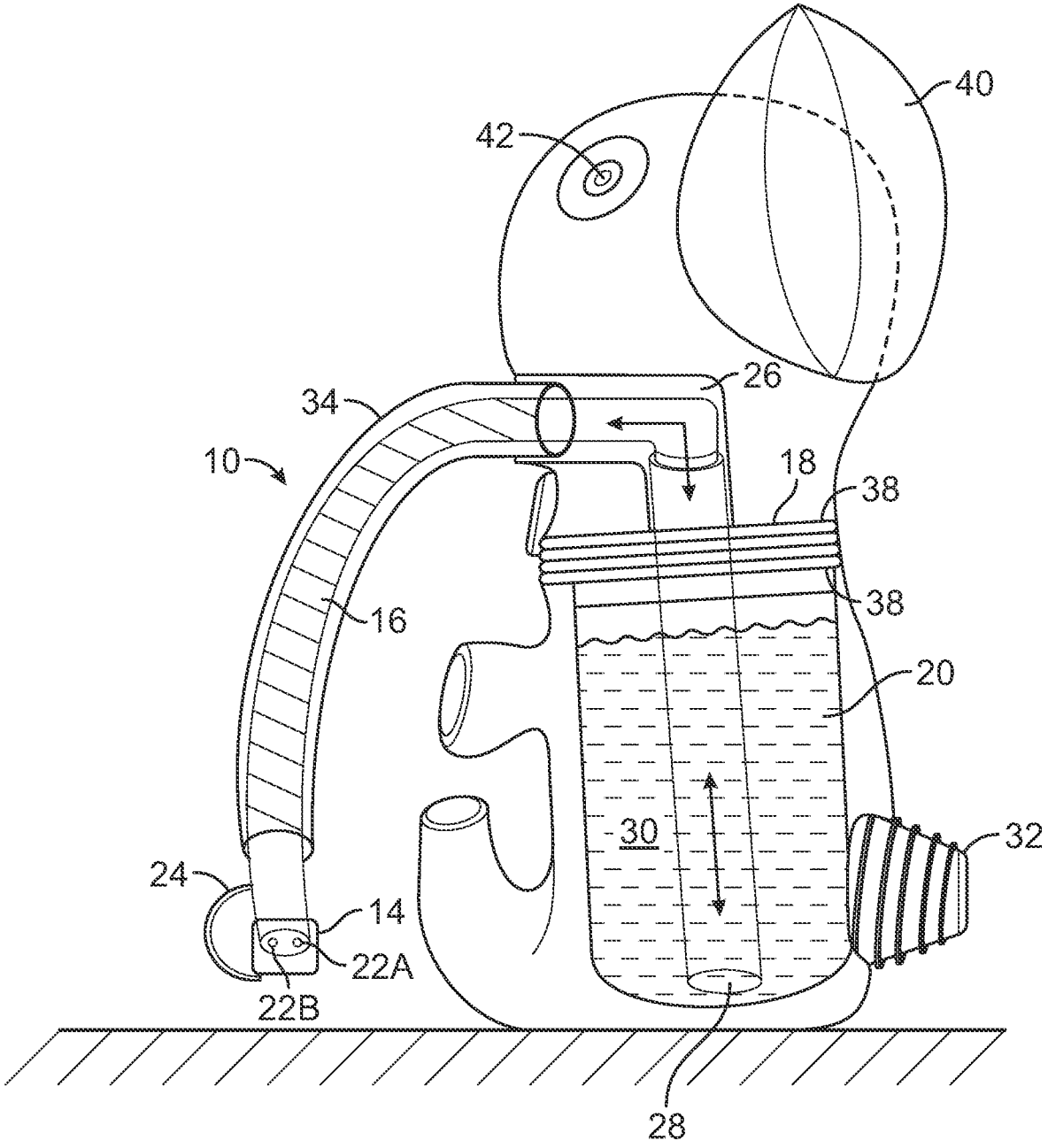
FIG. 2 is a side view of a representative example of the cup embodiment using the spout of the instant invention as a collapsing straw.

In FIG. 1 it can be seen that there can be two optional exit openings 22*a*, 22*b* of different sizes so that the flow rate of the fluid as it exits therefrom can be controlled to the desired rate. A disc valve (not shown) can be used to close and seal one or both flow ends to either cut off flow or choose the rate desired. It can toggle on to fully open to the larger hole, toggle to completely closed or toggle to the lower flow rate. A flow vent 36 can be located in the mouth area on the lid 18 to control and ventilate the flow. Like the disk valve, it can toggle completely shut, fully open to the largest exit aperture or to the lower flow rate. In the child's toy embodiment in FIG. 2, it is shown an endcap 24 suitable for that embodiment that can be closed when not in use so as to eliminate leakage. In the FIG. 2 illustration, one can see that the spout 10 can terminate at its base 12 and connect to an elbow 26 fitting which then is attached to a straw 28 that is submersible in the liquid 30. A reversible check valve 32 can be attached to any portion of the container so that when the person is sucking air though the straw 28 and spout 10, air does not re-enter the container 20. The ears 40 of the elephant can aid it turning the spout and the eyes 42 can be made to follow the user as an optical illusion and add novelty to the product.

Figure 3:
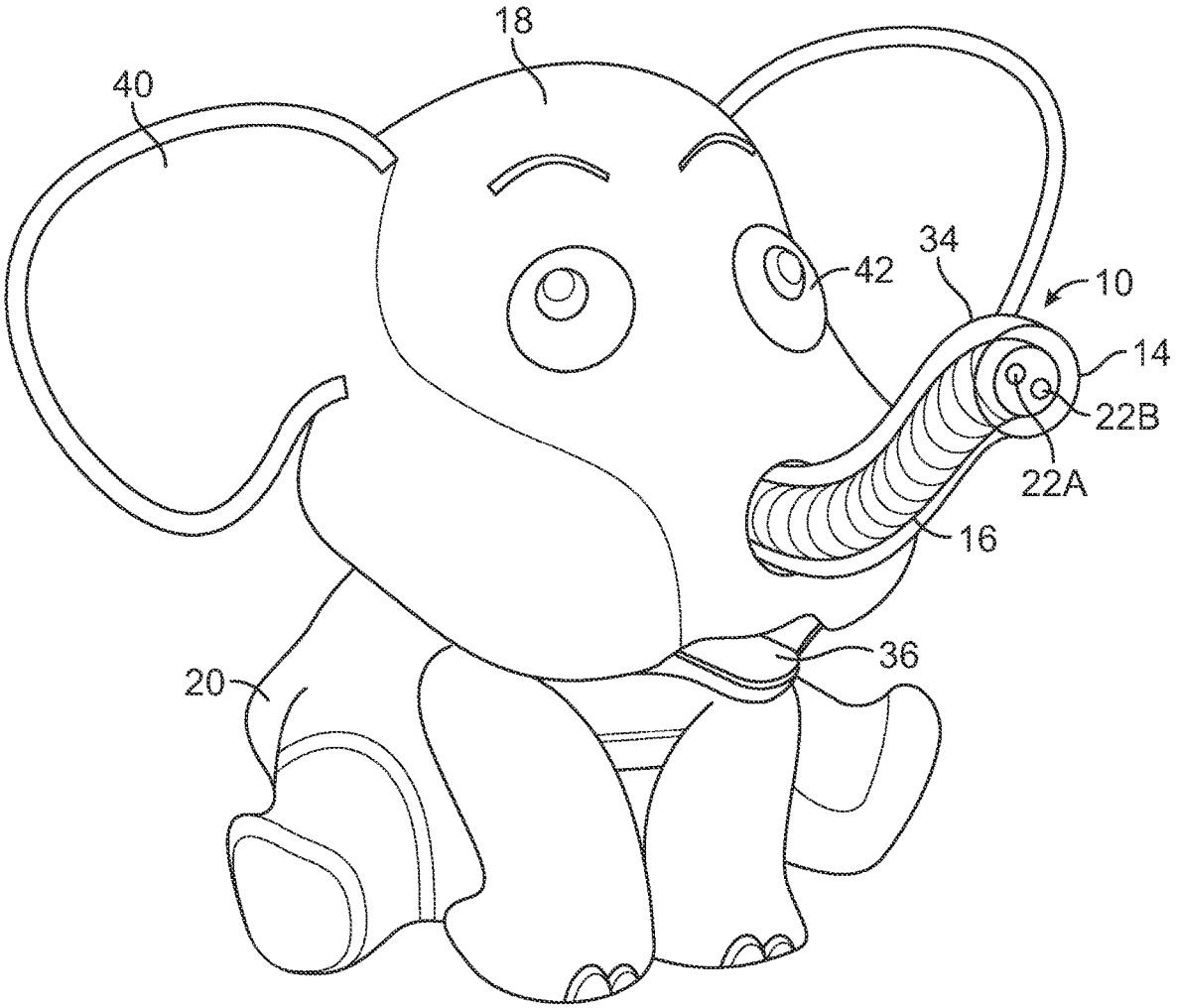
FIG. 3 is a perspective view of a representative example of a stylized cup embodiment using the spout of the instant invention as a telescoping straw.
Figure 4:
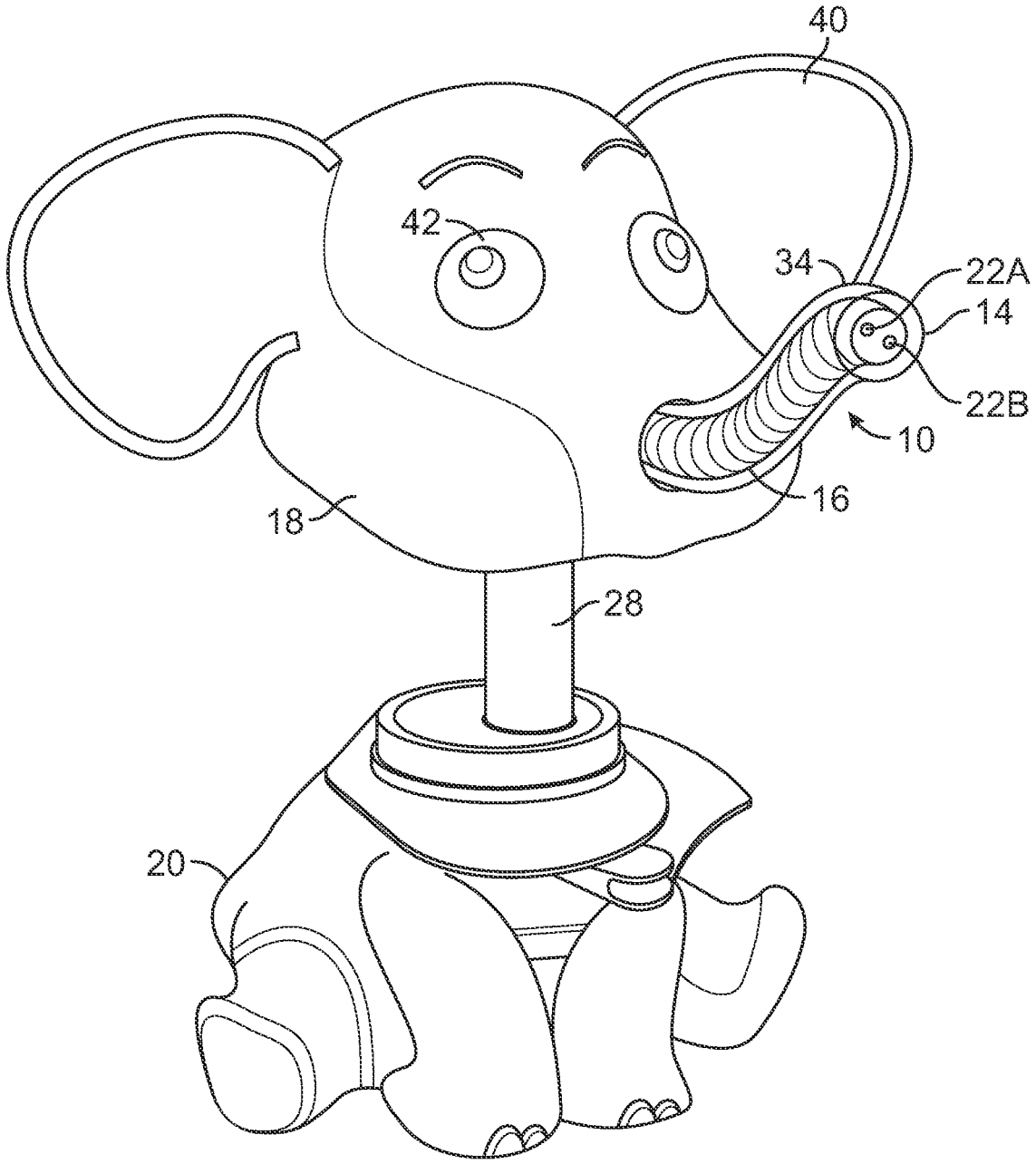
FIG. 4 is the same view as FIG. 3 but with the spout/cup lid removed from the liquid reservoir showing the internal straw portion that attaches to the spout.

FIGS. 3-4 show a more stylized version of the child's cup. In the version in FIG. 2, the spout is shown bent in line with the profile of the cup which is one way to manipulate the position of the spout 10. In FIGS. 3-4, the spout 10 would not as easily fold into the profile but could telescope back into the lid 18 to reduce the profile. An endcap 24, though not shown in FIGS. 3-4 can also be used to cap the spout 10. FIG. 4 shows the lid 18 removed from the container 18 such that the internal straw 28 is exposed.

The spout 10 can also include an outer sheath 34 such that the telescoping portions 16 are not visible from the outside which allows for more decorative and stylized choices for how the spout 10 appears. Depending on the animal chosen to illustrate, a tail (not shown) can be added near the valve 32 to hide it. In the case of the child's cup the lid 18 and the container 20 screw together easily through threads on both pieces. If the sheath 34 is made transparent, then fluids can be seen moving through the trunk when in use. This transparency will also allow for a changing of the position of the trunk to avoid spillage if fluid is still seen in the spout 10 when no longer in use.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A spout for the transfer of liquids comprising:

a base that is attachable to a receptacle for the collection or extraction of fluids, wherein said base is shaped to resemble an animal with a large appendage;

threading at said base that allows for attachment to said receptacle;

an extendible telescoping member extending from said base that allows for the flow of fluids therethrough as it exits said receptacle or as it is added to said receptacle; and a valve at an end of said telescoping member distal said base that controls the flow rate of fluids into or out from said telescoping member wherein a mouth consistent with the animal portrayed is included wherein a flow vent is situated in said mouth.

2. The spout as defined in claim 1 wherein a flow vent is attached to said base wherein said flow vent can be toggled fully open, fully closed or partially open.

3. The spout as defined in claim 1 wherein animal ears consistent with the animal portrayed are attached to said base to allow for gripping and turning of said spout for attachment through said threading to said receptacle.

4. The spout as defined in claim 1 wherein animal eyes consistent with the animal portrayed are attached to said base and wherein said animal eyes are constructed to provide the illusion that said eyes are following the user as the user moves.

5. The spout as defined in claim 1 wherein said appendage is surrounded by a sheath when said appendage is used as a straw to extract fluids from said receptacle.

6. The spout as defined in claim 5 wherein said straw is attached to an elbow joint that extends into said receptacle.

7. The spout as defined in claim 1 wherein a removable cap is attachable to said distal end of said appendage.

* * * * *